US005285535A

United States Patent [19]

Stewart et al.

[11] Patent Number: 5,285,535

[45] Date of Patent: Feb. 15, 1994

[54] PORTABLE TOILET FOR COLLAPSIBLE INCONTINENT WHEELCHAIR

[76] Inventors: Darlene A. Stewart, 14095 T.W.P. Rd. 136, Bellevue, Ohio 44811; Charles L. Ferrell, R.R. 1, Box 202-B, Milltown, Ind. 47145

[21] Appl. No.: 41,204

[22] Filed: Apr. 1, 1993

[51] Int. Cl.[5] ..... A47K 11/00

[52] U.S. Cl. ..... 4/480; 297/DIG. 4; 4/483

[58] Field of Search ..... 4/479, 480, 483, 484, 4/902; 280/650; 297/DIG. 4, 44, 45

[56] References Cited

U.S. PATENT DOCUMENTS 2,592,405 4/1952 Everest et al. ..... 155/140
2,810,429 10/1957 Lane et al. ..... 297/DIG. 4
3,062,582 11/1962 Baldwin ..... 4/480
3,343,482 8/1982 Wegner ..... 280/42
4,296,506 10/1981 Stoute, Sr. et al. ..... 4/480
4,917,395 4/1990 Gabriele ..... 280/650

FOREIGN PATENT DOCUMENTS 8501866 5/1985 PCT Int'l Appl. ..... 4/480

*Primary Examiner*—Ernest G. Cusick
*Assistant Examiner*—Gregory Vidovich
*Attorney, Agent, or Firm*—Laurence R. Brown

[57] ABSTRACT

A collapsible wheelchair assembly is provided that may be folded for storage with attached toilet seat. A waste pan is interlocked with wheelchair braces to sit under a flexible plastic seat, having a toilet opening, that hinges when the wheelchair is folded. Thus, a portable collapsible toilet facility is afforded incontinent patients for use in transit whenever necessary.

7 Claims, 2 Drawing Sheets

PORTABLE TOILET FOR COLLAPSIBLE INCONTINENT WHEELCHAIR

TECHNICAL FIELD

This invention relates to wheelchairs for permitting handicapped persons to use a toilet whenever necessary without moving out of a seated position in the wheelchair, and more particularly it relates to wheelchair construction features that permit a wheelchair with portable toilet facilities to be readily folded and stored.

BACKGROUND ART

Foldable wheelchairs with toilet facilities have been introduced into the art with rigid seats that must be removed to fold the wheelchair. Examples of this art are seen in U.S. Pat. Nos. 2,592,406, H. A. Everest, et al., Apr. 8, 1952 and 4,343,482, D. F. Wegner, Aug. 10, 1982.

These chairs however are hard to manipulate by handicapped persons, and cannot be used until the wheelchair is backed into a toilet over a resident toilet stool before use. Also they have the deficiency that they cannot be easily collapsed by handicapped persons or stored intact because rigid seats must be removed, handled and treated as a separate item. Furthermore, there is no feasibility of using these wheelchairs in an emergency, without finding an unused bathroom with a toilet bowl that matches the construction of the wheelchair, so that they are not adaptable for use with incontinent patients.

In particular, in the case of incontinence, the aforementioned prior art wheelchairs are unsuitable.

It is therefore an objective of this invention to provide improved incontinent wheelchairs for the handicapped that may be simply folded for storage as a unitary assembly with seat in place, to be stowed in an automobile, for example.

It is also an objective of this invention to provide a self contained portable toilet chair which can be used at any time, and is not restricted to use with a toilet bowl in a public restroom, for example.

DISCLOSURE OF THE INVENTION

A wheelchair, collapsible for compact storage, is provided with a self contained toilet facility for use by incontinent handicapped patients. The wheelchair has two wheeled side members with crossed and pivoted folding bracing mechanisms, or equivalent, for folding the two side members from the in-use chair posture into side-by-side folded positions for compact storage. Folding and unfolding is achieved without disassembly and assembly of parts of the chair by provision of flexible plastic back and seat members that are fastened to and retained by the side members in both collapsed and in-use postures.

The seat is formed from a flexible bacteria resistant vinyl plastic sheet material for a smooth upper surface to sit upon, hinged at the center to fold with the chair and having a centrally located discharge opening. The back is a flexible sheet, preferably of the same bacteria resistant material. Both seat and back are securely fastened to each side member to bear the load of a person sitting and leaning back when using the wheelchair.

Fitting under the seat and discharge opening is a removably held waste pan with interlocking configuration that seats securely into wingbrace structure that separates and supports the two side members when the wheelchair is uncollapsed in its in-use posture.

Other features, advantages and objectives of the invention will be found throughout the following description, claims and accompanying drawings.

BRIEF DESCRIPTION OF THE DRAWINGS

In the accompanying drawings, wherein similar reference characters represent similar features throughout the several views.

THE PREFERRED EMBODIMENT

Figure 1:
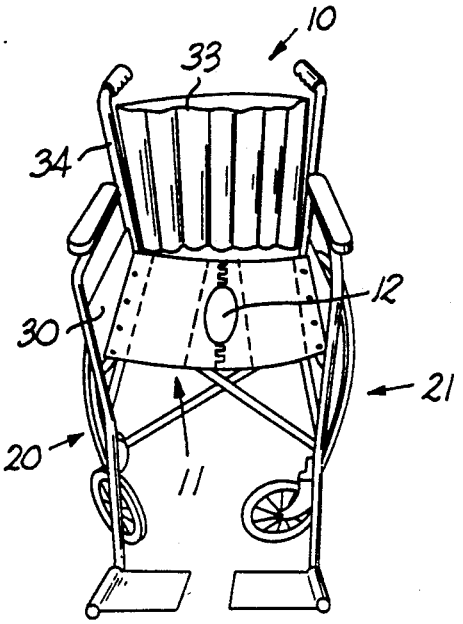
FIG. 1 is a front perspective view of an incontinent collapsible wheelchair embodiment of the invention.

Now with reference to FIG. 1, the incontinent collapsible wheelchair 10 is provided with a hinged seat 11 having a toilet opening 12 disposed centrally therein. The construction of that seat 11 provides for hinging structure 14 along a pivot axis 15 extending on either side of the toilet opening 12 and parallel to the side bracing members 16, 17. The seat comprises plastic sheeting, preferably a bacteria resistant vinyl well known in the art, which is firmly affixed to bracing members 16, 17 on the respective side members 20,.21 of the wheelchair 10 by suitable fasteners 19 so that the seat 11 supports the weight of a patient.

Figure 2:
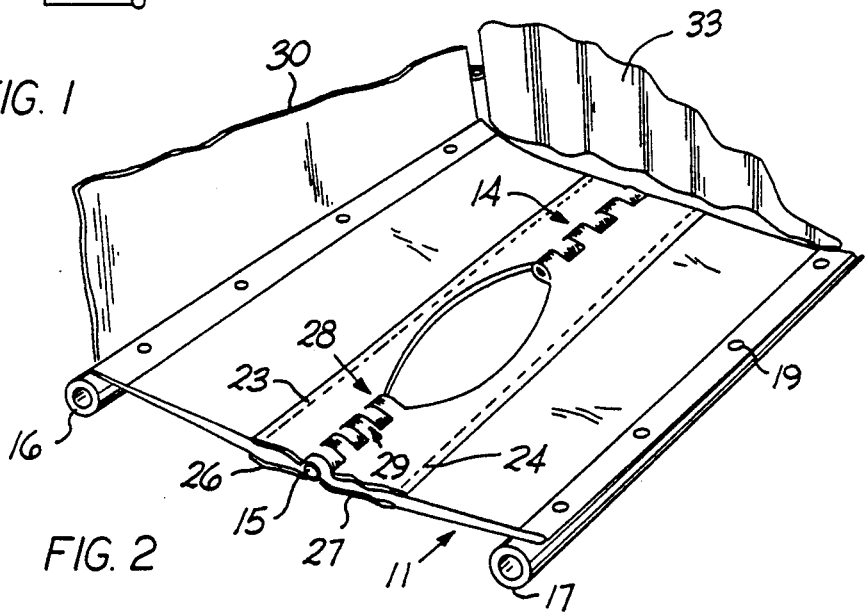
FIG. 2 is a detailed fragmental perspective view of the construction of a hinged seat with a discharge opening provided in accordance with this invention.

The upper surface of the seat 11 is smooth and flat, held tautly when the chair is uncollapsed in its in-use posture. As seen best from FIG. 2, the plastic is folded over a stiff rod, such as steel, along the axis 15, and stitched at seams 23, 24 so that flaps 26, 27 lie underneath the seat as the sectioned portion of the plastic illustrates. The plastic has interdigitated fingers 28, 29 forming a hinge that readily folds when the wheelchair is collapsed to move sides 20, 21 together for compact storage.

Sidewall screens 30 may be used for privacy. The flexible fabric back 33, preferably of the same bacteria resisting vinyl as the seat is similarly tautly held as fastened to handle bar posts 34, 35. The back therefore collapses and folds when the sidepieces 20, 21 are moved together.

Figure 3:
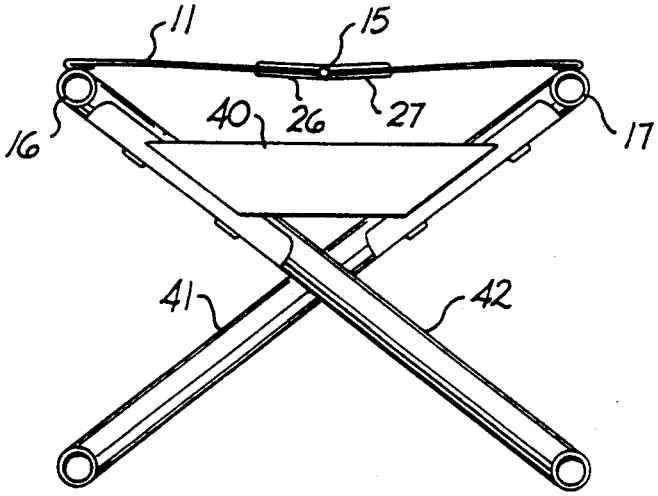
FIG. 3 is a fragmental front view of the incontinent wheelchair with a waste pan in place to provide a portable toilet facility.

In FIG. 3, the removable waste pan 40 is shown in place the seat when the pivoted crossbraces 41, 42 are in their in-use position. The entry and removal of the waste pan from the wheelchair is illustrated by dotted lines 45, 46 in FIG. 4.

Figure 4:
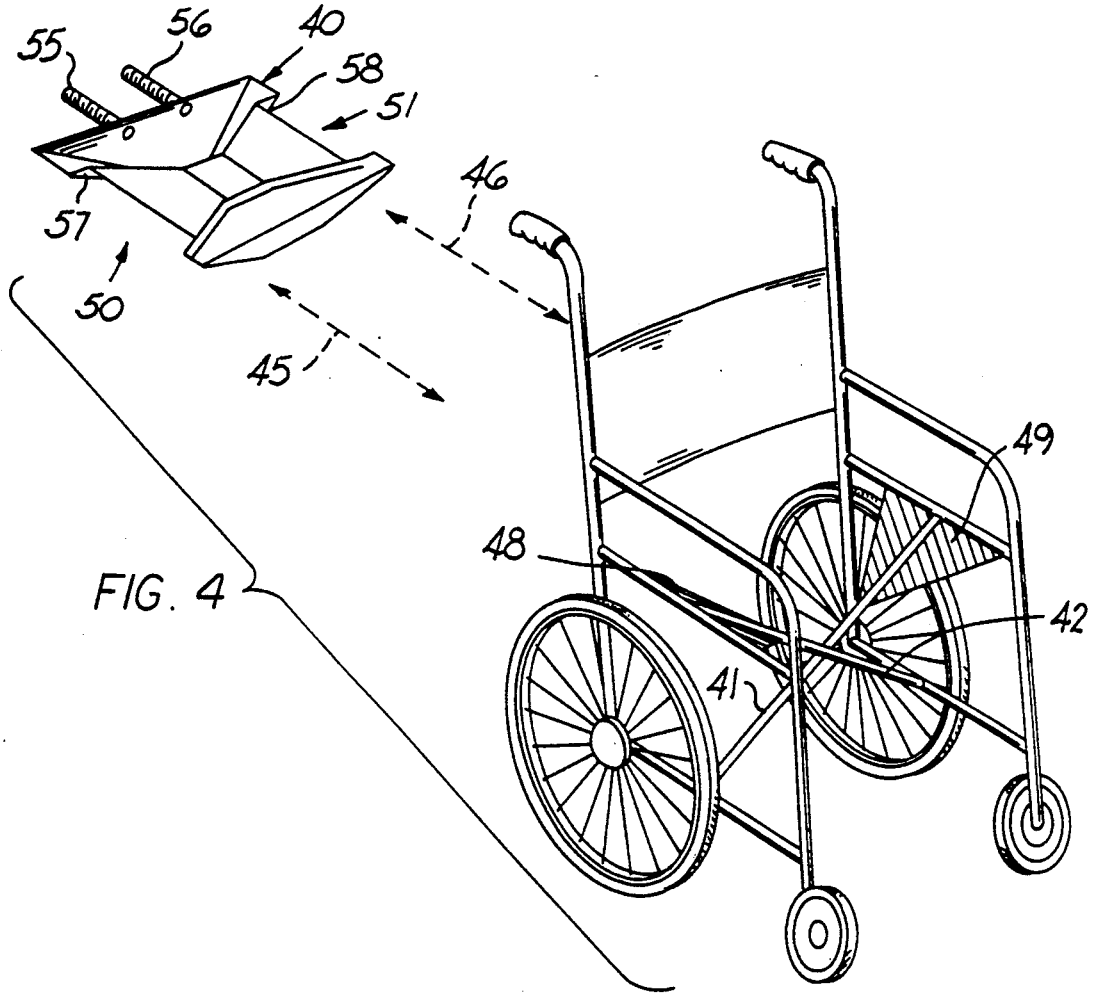
FIG. 4 is an exploded view of the wheelchair showing in dotted lines the insertion path for the interlocking waste pan provided by this invention.
Figure 5:
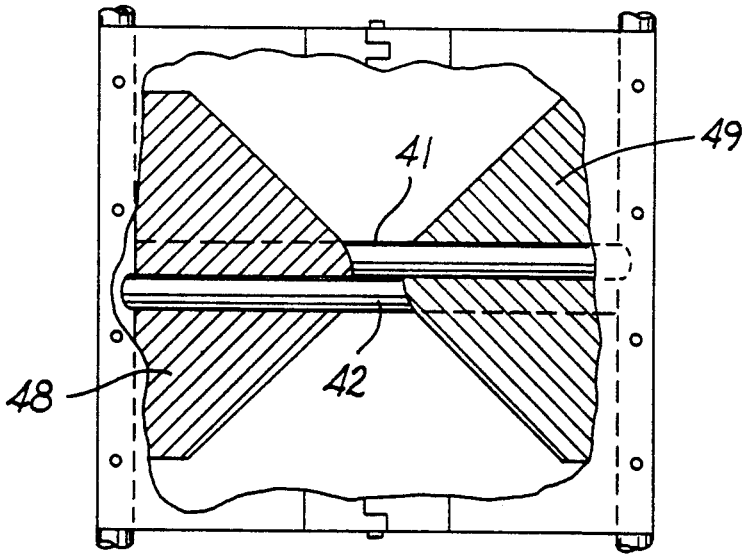
FIG. 5 is a bottom view, partly broken away showing bracing structure under the seat for holding the wheelchair in uncollapsed in-use posture.

The waste pan has interlocking structure on opposite sides 50, 51 that interfits respectively with the winged brace structure 48, 49 at the upper ends of the pivoted bracing legs 41, 42, as shown in FIGS. 4 and 5. The wings 48, 49 are preferably rubber or rubberized for damping noise and for frictionally locking the pan 40 more firmly in place.

It can be seen that the pan 40 is manually inserted by way of handles 55, 56, to a mating position over the wings 48, 49 and lowered into place to interlock. the flanges 57, 58, etc. facing downwardly thereby constitute overlapping structure extending below the wings 48, 49. Thus to remove the pan 40, it must be lifted upwardly to unseat and then moved out as the arrows 45, 46 show.

It is therefore evident that this wheelchair structure, with its portable in situ toilet facilities, permits incontinent patients to comfortably ride and to use the toilet as often as needed. Accordingly the state of the art is improved by the novel features afforded by this invention. Those novel features believed descriptive of the spirit and nature of this invention are defined with particularity in the following claims.

We claim:

1. A toilet seat for use in a wheel chair framework having side support rails on opposite sides of an occupant for supporting a seat and a folding mechanism for moving the side rails together in a compact collapsed condition and apart to form a mobile chair, comprising in combination:

a seat for attachment to the support rails on opposite sides of said occupant to form soft flexible plastic seat extending between the support rails and having a central discharge opening extending through the seat, waste pan supporting means for removably supporting a waste pan under said discharge opening on the wheelchair framework below and spaced from said seat, and hinging means in the seat between the support rails permitting the seat to be hinged and retained in folded position while attached to the side rails when the wheelchair is in its compact collapsed condition.

2. The seat defined in claim 1 wherein said plastic seat further comprises a bacteria resistant vinyl sheet with attachment means for securing the sheet to the side rails.

3. The seat defined in claim 2 wherein said hinging means further comprises a pair of coaxially aligned hinges extending substantially parallel to the side rails forwardly and rearwardly from the discharge opening, said hinges being formed at an intersection of two adjoining sections of said plastic sheet and comprising folded and stitched plastic sheet material with interdigited central fingers mated about a pair of stiff rods.

4. A collapsible wheel chair of the type with two sidepiece panels which move apart from adjacent positions in a collapsed storage position to a separated apart position forming a seat with toilet facilities for use by incontinent occupants comprising in combination:

two wheelchair sidepieces disposed on opposite sides of an occupant, each forming wheels, a set of separated side sections comprising: handles, armrests and bracing bars interconnected as a frame for attachment of seat, back and bracing hardware for forming a chair, a set of inter-sidepiece braces pivoted together in a central wheelchair location respectively extending between and coupled with the two sidepieces substantially between one sidepiece to seat bracing bars on the other sidepiece for retaining the sidepieces in two optional positions, one with the sidepieces separated to receive an occupant and another with the sidepieces collapsed for storage with the sidepieces to rest side by side, a flexible back disposed between the two separated handles adapted to fold when the sidepieces are collapsed for storage, a flexible plastic seat comprising a flexible plastic member disposed between and attached to the two separated sidepieces with a toilet opening comprising an opening in the flexible plastic member disposed in a central region and intermediate hinging structure at the toilet opening adapted to fold the plastic member into a position between the two sidepieces when the wheelchair is collapsed for storage with the sidepieces in adjacent positions, and waste pan mounting means on the frame separated from the flexible plastic seat.

5. The wheelchair of claim 4 further comprising a waste pan receptacle removably resting at a distance below the seat between the seat and the pivot position of the inter-sidepiece braces.

6. The wheelchair of claim 5 wherein the waste pan and intersidepiece braces are provided with interlocking structure for holding the pan in place under the toilet opening.

7. The wheel chair of claim 4 provided with a waste pan removably held in a position beneath the toilet opening and insertable from a position behind the wheelchair back thereby permitting removal without disturbing a wheelchair occupant.

* * * * *